US007654524B2

(12) United States Patent
Thomson

(10) Patent No.: US 7,654,524 B2
(45) Date of Patent: Feb. 2, 2010

(54) MULTI-FEED DETECTION INDEPENDENT OF NUMBER OF SHEETS OR TYPE OF SHEETS

(75) Inventor: Michael B Thomson, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 23 days.

(21) Appl. No.: 12/119,605

(22) Filed: May 13, 2008

(65) Prior Publication Data

US 2009/0026690 A1 Jan. 29, 2009

Related U.S. Application Data

(60) Provisional application No. 60/937,235, filed on Jun. 26, 2007.

(51) Int. Cl.
*B65H 7/02* (2006.01)

(52) U.S. Cl. ..... 271/262; 271/265.04; 271/242

(58) Field of Classification Search ..... 271/262, 271/265.04, 259, 236, 242, 258.01–258.04, 271/3.15, 3.17, 10.02, 10.03
See application file for complete search history.

(56) References Cited

U.S. PATENT DOCUMENTS

| | | | | |
|---|---|---|---|---|
| 5,222,724 | A * | 6/1993 | Hirano et al. | 271/10.11 |
| 5,362,041 | A * | 11/1994 | Ryuzaki et al. | 271/236 |
| 6,460,687 | B1 * | 10/2002 | Escobedo et al. | 198/624 |
| 6,540,222 | B2 * | 4/2003 | Araki et al. | 271/122 |
| 7,270,325 | B2 * | 9/2007 | Sano et al. | 271/262 |
| 7,347,419 | B2 * | 3/2008 | Sano et al. | 271/265.04 |
| 2001/0042956 | A1 * | 11/2001 | Minoru et al. | 271/265.04 |
| 2005/0184453 | A1 * | 8/2005 | Sano et al. | 271/262 |

* cited by examiner

*Primary Examiner*—Kaitlin S Joerger
(74) *Attorney, Agent, or Firm*—James J. Ralabate

(57) ABSTRACT

This is a simple and effective multi-feed system for use in marking apparatus where the transport of paper or other media is vital. The system is independent of the weight or type of paper used as was not the case in the prior art. The present system employs the natural strength and thickness of the paper to separate one sheet from the other. This separation is used to trigger a detector alerting the system of a multi-feed of paper.

10 Claims, 2 Drawing Sheets

MULTI-FEED DETECTION INDEPENDENT OF NUMBER OF SHEETS OR TYPE OF SHEETS

This application is a Non-Provisional Application corresponding to Provisional Application Ser. No. 60/937,235 filed in the U.S. Patent and Trademark Office on Jun. 26, 2007.

This invention relates to media or paper moving marking systems and apparatus and, more specifically, to a media feeder system used in post printing processes.

BACKGROUND

Marking systems that transport paper or other media are well known in the art. These marking systems include electrostatic marking system, non-electrostatic marking systems, printers or any other marking system where paper or other flexible media or receiving sheets are transported internally to an output device, such as a finisher and compiler. Many systems are used for transporting, collecting, or gathering printed sheets so that they may be formed into books, pamphlets, forms, sales literature, instruction books and manuals and the like. For simplicity and clarity the present invention will be described in relation to an electrostatic marking system; however, the present system may be used in any paper handling system or structure.

The finisher and compiler are generally located at a site in these marking systems after the receiving sheets (paper) have been marked. A finisher is generally defined as an output device that has various post printer functions or options such as hole punching, corner stapling, edge stapling, sheet and set stacking, letter or tri-folding, Z-folding, Bi-folding, signature booklet making, set binding [including thermal, tape and perfect binding], trimming, post process sheet insertion, saddle stitching and others.

The compiler often employs a compiling wall or tray where frictional drive elements hereinafter elastomer paddle wheels or "paddle wheels" (PW) are used to drive media sheets (paper) against the compiling wall for registration of the staple or bind edge of a set. These sheets in today's high speed printers and multi-functional machines may be fed to a compiling wall or other post processing means by high speed multi-feeders.

The compiling capacity, bind edge sheet registration and post printing steps can be compromised by these high speed multi-feeds system where an unintended extra sheet destroys the integrity of a collated set or sequence of post processing functions. These functions, as above noted, include finishing stations, envelope stuffers and similar processing where inconsistent feeding systems destroy the integrity and unreliability of a set of media fed thereto. Some current multi-detectors have had limited success because they work with paper stiffness properties and media varies from job to job. Other multi-feed systems work with ultrasonic sensors and are relatively expensive. A feed system that is less expensive, simple and less dependent on media type would be a huge step forward. Even ordinary offices are stepping up their efforts at in-house production of conference paper, simple booklets, manuals and other materials by establishing service departments for intensively processing prints in large quantities. Such customers require post-processing functions, such as high-speed/high-precision punching, stapling and paper folding work with simultaneous print output and realization of high-speed/high-quality print output with a high degree of reliability of the feeders.

SUMMARY

Embodiments of the present media feed invention, employ the natural strength and thickness of the paper media to separate one media sheet from another; this separation can then be used to trigger a detector, alerting the system of a multi-feed, including an inner and an outer media sheet. The outer sheet being forced to take a longer path than the inner sheet causes this separation. The media sheet is sent around a curved baffle or paper guide between two articulating drive nips, the baffle is then removed and the media path straightened so forcing the outer sheet(s) to buckle away from the inner sheet.

The present invention thereby provides a simple, reliable multi-feed system with a detection device.

A multi-feed system can be defined as two or more sheets, not separated during feed, that are traveling through the media path as one. This multi feed is difficult to detect. The proposed device comprises two nips and a set of curved paper baffles. A sheet (or more) is driven through the first nip, then around the curved baffle set and finally into the second nip. Once the media are in both nips, the lower baffle is moved and the nip pairs are straightened. The second nip is then over driven. If one sheet is present, the buckle is removed, but the outer sheets will not. Some amount of buckle will remain. A CCD sensor looking at the edge will detect more than one sheet and a multi-feed will be declared. The appropriate action can then be taken by the control system. This provides a feeder system that solves a long-standing problem. Some current multi-feed detectors have limited success because they work with paper stiffness properties and the media varies job-to-job. Other multi-feed detectors work with ultrasonic sensors and are expensive. The advantages in the present invention are simplicity and better functionality independent of media type. (Please define what type of "detector device" is used and what a "CCD sensor" is. Also please describe the "control system action" in more detail.) i.e. "The appropriate action can then be taken by the control system."

DETAILED DISCUSSION OF DRAWINGS AND PREFERRED EMBODIMENTS

Figure 1:
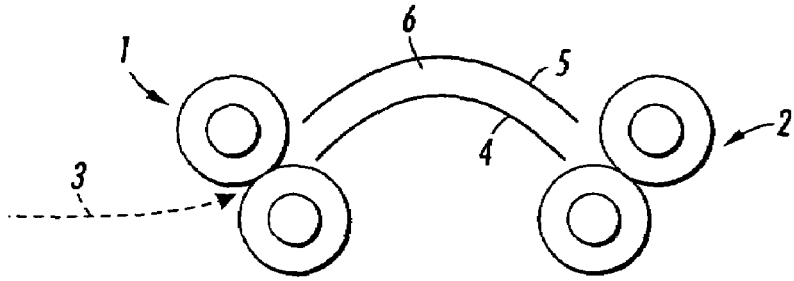
FIG. 1 illustrates a diagram of the initial feeder configuration; the following figures illustrate sequential steps.
Figure 2:
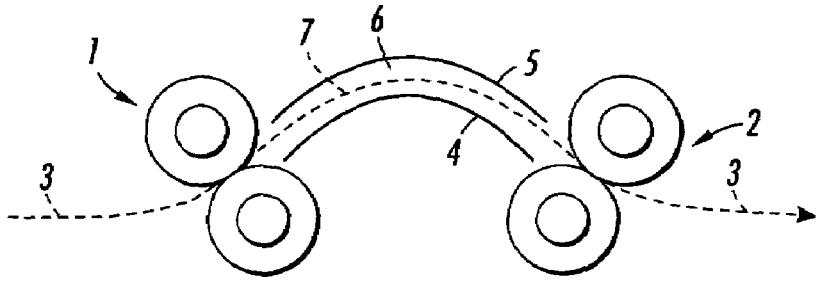
FIG. 2 illustrates the next step after the step of FIG. 1.
Figure 3:
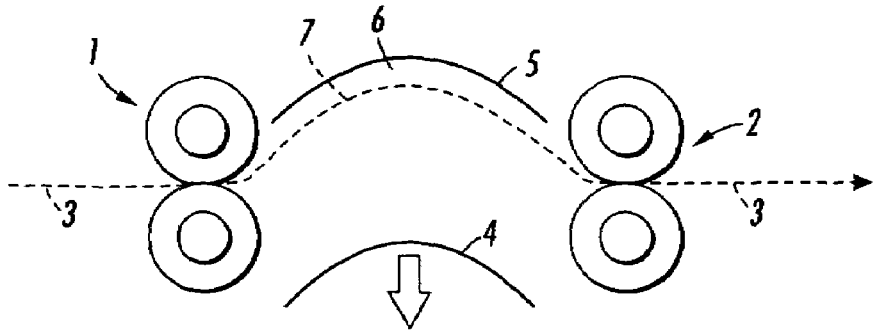
FIG. 3 illustrates the step after FIG. 2 step.
Figure 4:
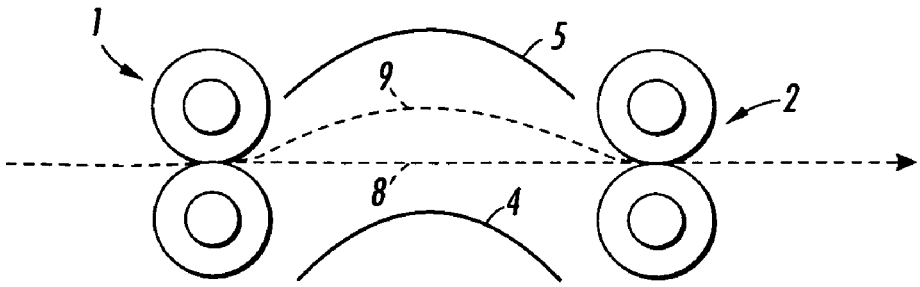
FIG. 4 illustrates the step after FIG. 3 step.
Figure 5:
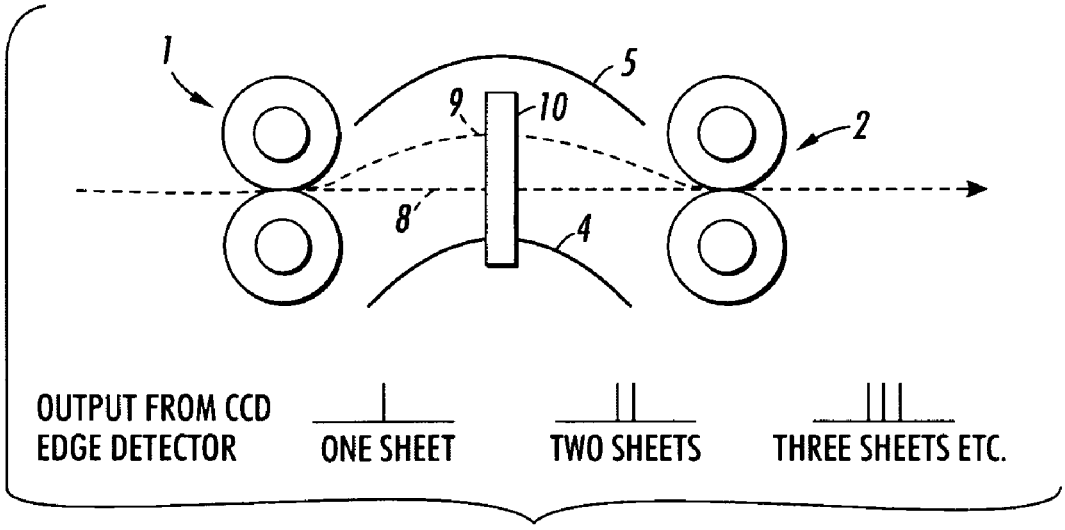
FIG. 5 illustrates the step after FIG. 4 step.

In FIGS. 1 and 2, two pairs of drive nips 1 and 2 form part of the system's paper path and are used to force the media 3 into a tight curve between the inner guide or baffle 4 and the outer guide or baffle 5. Both halves of the nips 1 and 2 are driven at the same speed and sprung together so gripping the media or paper sheet 3. The media or paper sheet 3 is fed into the space 6 between paper guides 4 and 5 and continuously fed until media 3 passes between nip 1 and nip 2. The media 3 then held by nip 1 through space 6 and to nip 2. Once the media 3 is in both nips 1 and 2, the inner guide or baffle 4 is moved back and the nip pairs 1 and 2 are straightened as shown in FIG. 3. When the term "straightened" is used in the present disclosure and present claims, it means the position of the nips as shown in FIGS. 3, 4, and 5. Media 3 still has a buckle 7 as shown in FIGS. 3, 4, and 5. The nips 1 and 2 are straightened (or in horizontal alignment) so that a straight sheet path for sheet 8 is provided as shown by arrow in FIG.

5. Once inner guide 4 is vertically moved back, nip 2 is over driven to remove or reduce the media buckle 7 between the nips 1 and 2 as shown in FIG. 4. Additional media are fed through the system. At the point where the inner sheet 8 becomes straight, the outer sheet(s) 9 still has extra length resulting from being forced to go further than the inner sheet 8. A detector 10 is positioned at a location between nips 1 and 2 and in alignment with the media 3 path. Media 3, as shown in FIG. 4, becomes made up of inner sheet(s) 8 and outer sheet(s) 9. The detector 10 can then alert the system that there is a multi-feed and appropriate action such as taken by the control system.

Thus, the above figures describe an embodiment where a simple and effective multi-feed detection system is provided that is independent of the number of sheets or media fed through the system. Also, the system is independent of the weight or type of media used which caused problems in prior art feeding systems. The present system, as above noted, employs the natural strength and thickness to the media to separate one sheet from another. This separation can then be used to trigger a detector, as shown in FIG. 5 alerting the system of a multi-feed. The other media sheet being forced to take a longer path than the inner sheet causes the separation.

In summary, the present embodiments comprise a multi-feed system useful in a media or paper marking device, including an electrostatic marking system. This system comprises an operative arrangement, a sensor, at least two nips, a first and a second nip, and a set of curved paper baffles made up of an inner and outer baffle. In passage alignment with the nips, these baffles have a curved space there between for the passage of paper there through. The first nip is enabled to receive one or more sheets to be driven there through. The curved baffle set is enabled to receive the paper from the first nip, to form a buckle in said media. The second nip is adapted to receive the sheet(s) after it passes through said baffle set. The inner baffle is enabled to be moved once the media sheet is in both nips. The second nip is enabled to be over driven to at least reduce said buckle. When multiple sheets are fed, the sensor is enabled to detect the presence of more than one sheet and said system is adjusted to handle a multi-feed situation.

In this system, two curved baffles are used, an inner and an outer baffle and the baffles are separated in parallel to form a uniform space there between enabled to provide a buckle in said media and a passage of the media from the first nip to the second nip. The nips are enabled to be straightened once the inner baffle is moved out of the way. The marking system is preferably an electrostatic marking system.

This system is useful in a multi-feed system of a marking device, as earlier noted, including an electrostatic marking device. The method comprises the steps of feeding a media sheet through a system having at least two nips, a first and a second nip, each located one opposite open sides of a pair of curved baffles; i.e. an inner and an outer baffle. This provides a curved space between each baffle to allow sheets to travel there through and form a buckle. The media is forced into a curved configuration when it passes through this space then allowing the nips to travel at the same speed as the media is gripped in both nips. Once the media is in both nips, the inner baffle is moved back, and the nips are straightened. Then, overdriving the second nip to reduce the buckle in an outer sheet and an inner sheet then becomes straight allowing the outer sheet to have an extra length resulting from the outer sheet being forced to go further than the inner sheet. A detector is provided to alert the system that there is a multi-feed situation in said system.

In this method of baffles are separated in parallel to form a uniform space there between and enabled to provide a buckle in the media and a passage of said media from the first to the second nip and whereby the nips are straightened once the inner baffle is moved. Also, the second nip when overdriven is enabled to reduce the inner sheet buckle when more than one sheet is present.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A multi-feed system useful in a media or paper marking device comprising:

a sensor, a first nip and a second nip, both said first and said second nips being movable, a set of curved parallel baffles comprising an inner curved baffle and an outer curved baffle, said baffles located between said first and second nips, said baffles having a space therebetween, said space configured to allow passage therein of at least one of said media, said set of curved baffles configured to receive in said space said media from said first nip to form a media buckle between said nips, said second nip configured to receive said media after it passes through said space, said inner curved baffle configured to be moved vertically down or back away from said outer baffle and said first and second nips are configured to be straightened in a horizontal alignment, said second nip configured to be overdriven to remove or reduce said buckle in said media and permit a straight sheet path to be provided from said first nip and said second nip.

2. The system of claim 1 when multiple sheets of said media are fed in said system, said sensor is configured to detect a presence of more than one media sheet to permit said system to handle a multi-feed process.

3. The system of claim 1 wherein said baffles are originally vertically separated in parallel to form a uniform space there between configured to provide a buckle in said media and a passage of said media from said first nip to said second nip.

4. The system of claim 1 whereby said nips are configured to be straightened or horizontally aligned once said inner baffle is moved vertically away from said outer baffle.

5. The system of claim 1 wherein said second nip is configured when separated in parallel to be overdriven to reduce an inner sheet buckle when more than one sheet is present.

6. The marking device of claim 1 being an electrostatic marking device.

7. A method useful in a multi-feed system of a marking device which comprises the steps of:

feeding a media sheet through a system having at least two nips, a first and a second nip, providing each nip located opposite open sides of a pair of curved parallel baffles an inner and an outer baffle, providing a curved space between each baffle to allow said sheets to travel there through and thereby form a buckle, providing a step where said media is forced into a curved configuration when it passes through said space, allowing said nips to travel at the same speed as the media is gripped in both said nips, once said media is in both nips, said inner baffle is vertically moved back, and said nips are straightened or in horizontal alignment, once in horizontal alignment, overdriving said second nip to reduce said buckle in an outer sheet and an inner sheet becoming straight thereby allowing said outer sheet to have an extra length resulting from said outer sheet being forced to go further than said inner sheet, providing a detector enabled to alert said system that there is a multi-feed situation in said system.

8. The method of claim 7 wherein said baffles are separate in parallel to form a uniform space there between and enabled to provide a buckle in said media and a passage of said media from said first to said second nip, and whereby said nips are straightened once said inner baffle is moved.

9. The method of claim 7 wherein said second nip when overdriven once said nips are straightened is configured to reduce an inner sheet buckle when more than one sheet is present.

10. The method of claim 7 when used in an electrostatic marking system.

* * * * *